US006226893B1

(12) United States Patent
Schlamp et al.

(10) Patent No.: US 6,226,893 B1
(45) Date of Patent: May 8, 2001

(54) PEDICURE FOOTWEAR

(76) Inventors: Lori A. Schlamp; Steven K. Schlamp, both of 114 Privateer Ct., Jupiter, FL (US) 33458

( * ) Notice: Subject to any disclaimer, the term of this patent is extended or adjusted under 35 U.S.C. 154(b) by 0 days.

(21) Appl. No.: 09/498,597

(22) Filed: Feb. 4, 2000

(51) Int. Cl.[7] ..... A43B 3/12
(52) U.S. Cl. ..... 36/11.5; 36/94
(58) Field of Search ..... 36/11.5, 94, 8.1, 36/9 R

(56) References Cited

U.S. PATENT DOCUMENTS 1,867,679 * 7/1932 Riehle et al. ..... 36/11.5
1,943,829 * 1/1934 Koomruian ..... 36/11.5
2,096,500 * 10/1937 McCahan et al. ..... 36/11.5
2,390,685 * 12/1945 Benson ..... 36/11.5
3,099,884 * 8/1963 Kixmiller et al. ..... 36/11.5
4,017,987 * 4/1977 Perez, Jr. et al. ..... 36/11.5
4,030,212 * 6/1977 Ito ..... 36/11.5
5,615,496 * 4/1997 Sharpstein ..... 36/11.5
6,116,253 * 9/2000 Armstrong ..... 36/11.5

* cited by examiner

*Primary Examiner*—M. D. Patterson
(74) *Attorney, Agent, or Firm*—Glenn E. Gold

(57) ABSTRACT

A pedicure sandal (10) fabricated from a spongy foot form includes a base portion (12) having an outer perimeter shaped to accommodate a human foot and an integrally connected toe separating portion (18) selectively attached (20) to the base portion to form a plurality of toe-receiving loops (18*a–e*) for engaging and separating the wearers toes.

11 Claims, 2 Drawing Sheets

PEDICURE FOOTWEAR

FIELD OF THE INVENTION

This invention relates generally to footwear and more particularly to a disposable pedicure sandal wherein the structure of the sandal maintains the toes in a separated position and also prevents the foot from engaging the ground or other surface over which the wearer walks.

BACKGROUND OF THE INVENTION

During the performance of a pedicure it is necessary to maintain the toes of the pedicure recipient in a spaced apart relation to provide easy access by the person performing the pedicure, as well as to prevent damage to any of the beautification treatment performed on the toes. Furthermore, toe separation is preferred for a period of time following the pedicure to prevent damage to the beautification treatment due to inadvertent contact between adjacent toes. Historically, the separation of toes during pedicure treatments has been achieved using wads of tissue, cotton and like random articles. In addition, various toe spacing devices specifically designed for use during the performance of a pedicure are commercially available. More recently, various pedicure sandals and sandal systems have been developed in an effort to enable individuals to walk around after a pedicure without damaging the treatment.

U.S. Pat. No. 4,017,987 discloses a pedicure sandal assembly to be worn following a pedicure, including a base portion having a foot connecting strap and spacers mounted thereon. The sandal disclosed in the '987 patent has significant limitations. First, because the sandal is for use after a pedicure it does not address the issue of providing toe separation during the pedicure. Second, the disclosed sandal has a relatively complicated structure, requiring the assembly of a plurality of individual components during manufacture. Consequently, employing the disclosed assembly as a disposable sandal would be cost prohibitive.

U.S. Pat. No. 4,207,880 discloses a pedicure aid incorporating individually attachable toe separator subassemblies for separating the toes during and after a pedicure, and wearable as a sandal to protect the toes from damage after a pedicure. However, like the sandal disclosed in the '987 patent, the multi-component sandal assembly disclosed in the '880 patent would be impractical for use as a disposable pedicure sandal.

U.S. Pat. Nos. 5,870,837 and 5,946,823 disclose further pedicure sandal designs wearable during and after the pedicure procedure. However, each of the disclosed assemblies suffer from one or more of the aforementioned limitations.

Accordingly, there is a well established need for a comfortable pedicure sandal wearable both during and after the performance of a pedicure, wherein the construction of the sandal is conducive to its manufacture as a cost-effective disposable article.

SUMMARY OF THE INVENTION

It is an object of the present invention to provide a pedicure sandal designed for maintaining separation of the wearer's toes during and after a pedicure treatment.

It is another object of the present invention to provide a pedicure sandal designed for effectively preventing damage to the treated toes while enabling the wearer to walk about comfortably following a pedicure treatment.

It is a further object of the present invention to provide a pedicure sandal having a construction conducive to its cost-effective manufacture as a disposable article.

It is yet a further object of the present invention to provide a pedicure sandal having foot supporting and toe separating means constructed from a contiguous area of material.

It is still another object of the present invention to provide a disposable pedicure sandal having a means for being easily removed without contacting the treated toe nails of the wearer.

These and other objects are achieved by the pedicure sandal of the present invention which includes a base portion 12 for supporting a human foot, and an integral toe separating portion 18 for engaging the toes and maintaining a desired toe spacing. In particular, integral toe separating portion 18 is selectively attached to the upper surface 14 of base portion 12 at strategically located attachment regions 20 to form individual toe-receiving loops 18(*a–e*).

Each sandal is fabricated from a planar foot form 26 constructed from a spongy sheet of material for cushioning the foot of the wearer. Preferably, foot form 26 is provided with a single continuous cut along dotted line 23 to enable the partial detachment of a toe separating portion 18 from the base portion 12. Alternatively, foot form 26 can be manufactured partially detached along dotted line 23 to enable the toe separating portion 18 to be easily detached at a later time without requiring a cutting or shearing apparatus.

The toe separating portion 18 is preferably sewn, or stitched, to upper surface 14 of base portion 12. Alternatively, attachment can be achieved using mechanical fasteners, chemical adhesives, hook and pile attachments and heat seal means. Regardless of the attachment means employed, toe separating portion 18 is strategically secured to surface 14 to form individual toe receiving loops 18(*a–e*) sized for comfortably engaging the individual toes 40–44 of the wearer's foot, and positioned for maintaining adequate separation of said toes.

DETAILED DESCRIPTION OF THE PREFERRED EMBODIMENTS

In use, the pedicure sandals of the present invention are provided in pairs and include left and right sandals for being worn on the respective left and right feet of the pedicure recipient. The left and right pedicure sandals are substantially the same except one is adapted for the left foot and one adapted for the right foot. Although the following description and illustrations are directed primarily to the right pedicure sandal for the purpose of clarity, it is to be understood that the discussion is equally relevant to the left pedicure sandal.

Figure 1:
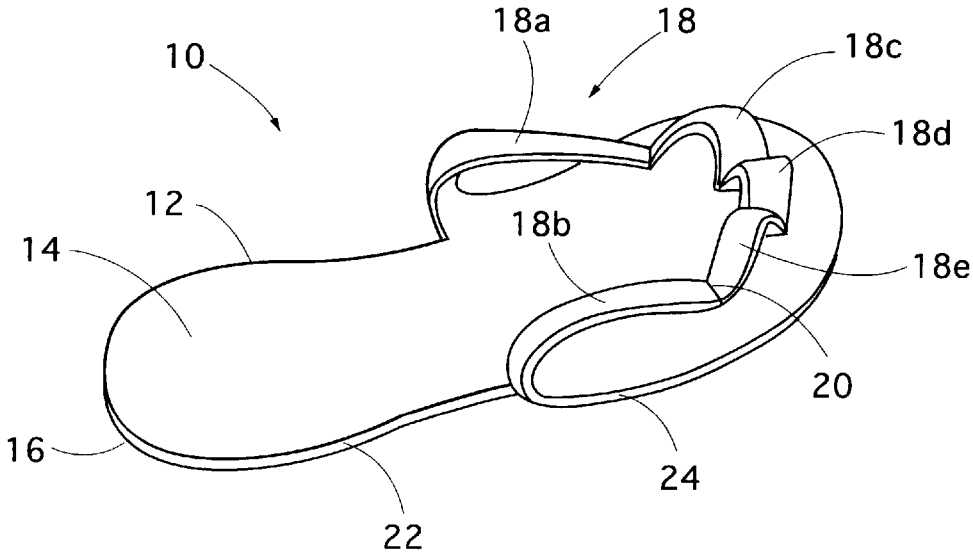
FIG. 1 is a perspective view of a fully constructed pedicure sandal in accordance with the preferred embodiment of the present invention.

Referring now to FIG. 1, the pedicure sandal 10 of the present invention is set forth in a completely fabricated state. The pedicure sandal 10 includes a base portion 12 for supporting a human foot, and an integral toe separating portion 18 for engaging the toes and maintaining a desired toe spacing. In particular, integral toe separating portion 18 is selectively attached to the upper surface 14 of base portion 12 at strategically located attachment regions 20 to form individual toe-receiving loops 18(*a–e*). As used herein, the term "integral" is intended to denote the unitary, or one piece, construction of the base and toe receiving portions.

Figure 2:
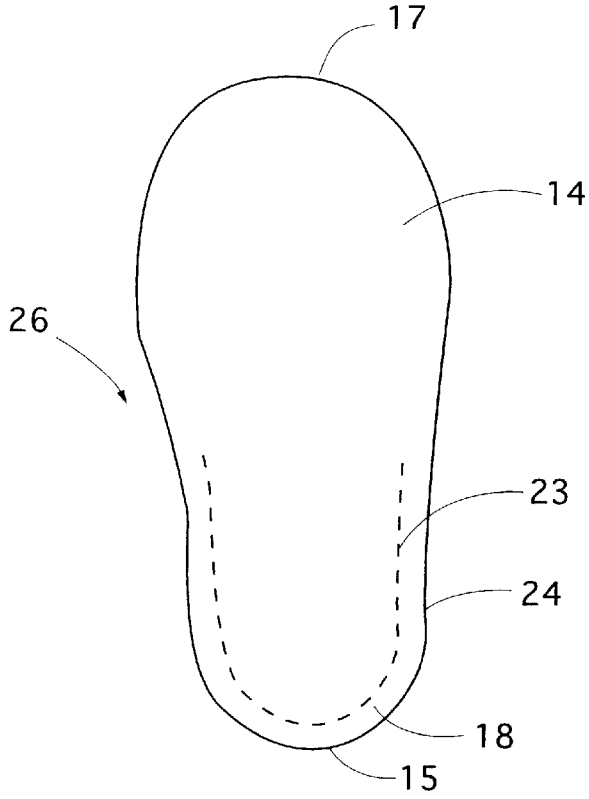
FIG. 2 is a top view of the pedicure footwear of the present invention in a partially fabricated state of construction, illustrating the location of the cut 23 made prior to attachment of the toe separating portion 18 to surface 14.

Referring now to FIG. 2, each sandal is fabricated from a planar member 26 having a perimeter defined by edge 24, and generally shaped for accommodating a human foot. In the preferred embodiment of the invention, a planar member 26 in the form of a human foot is cut from a larger area of spongy material (not shown) that provides for the cushioning of the foot when worn as a footwear. For example, the planar foot form 26 can be cut from a larger area of material using conventional die cutting equipment. The use of such equipment is well known in the art and further description is not provided herein. Although the use of an inexpensive sponge rubber material is preferred, the invention is not intended to be so limiting. It will be apparent to those skilled in the art of footwear manufacturing that the pedicure sandal of the present invention lends itself to fabrication using any of myriad flexible sheet-like materials, including flexible plastics and polymer foams. Furthermore, in lieu of the preferred single layer construction, foot form 26 can incorporate a multilayer construction.

Figure 3:
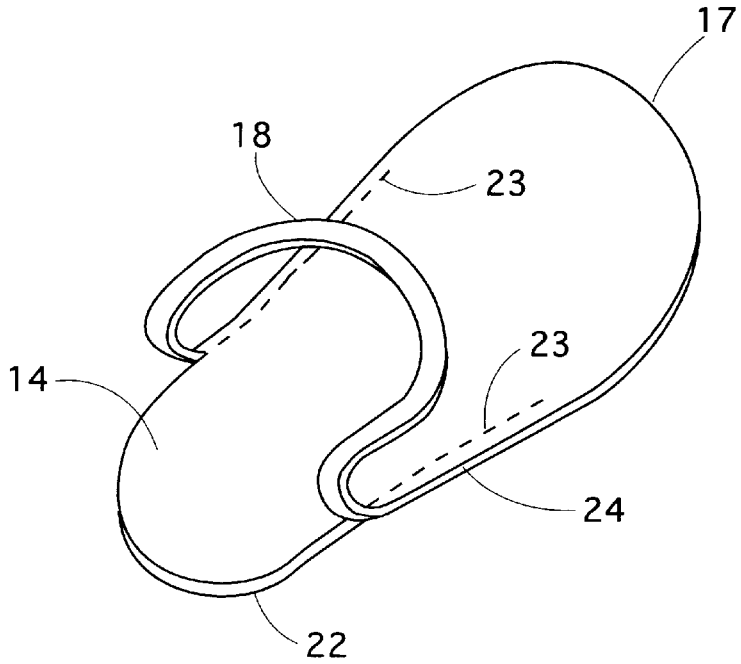
FIG. 3 is a perspective view of a partially fabricated pedicure footwear of the present invention, illustrating the partial detachment of the toe separating portion 18 from the initial foot form 26 of FIG. 3 during fabrication of the sandal.

Preferably, planar foot form 26 is provided with a single continuous cut (denoted by dotted line 23) to enable the partial detachment of toe separating portion 18 from base portion 12. More specifically, the cut 23 enables toe separating portion 18 to be separated from base portion 12 along the perimeter of planar foot form 26 proximate end 15, as clearly illustrated in FIG. 3. Alternatively, planar member 26 can be manufactured partially detached along dotted line 23 to enable the toe separating portion 18 to be easily detached at a later time without requiring a cutting or shearing apparatus. In other words, in this alternate embodiment of the invention toe separating portion 18 is frangible along phantom line 23. For example, partial detachment can be achieved by providing a series of perforations along phantom line 23.

Figure 4:
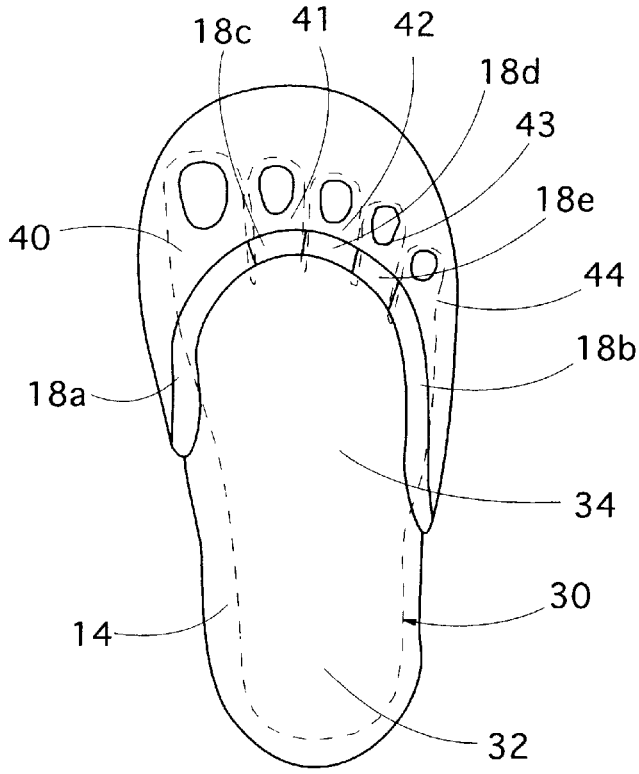
FIG. 4 is a top view of the pedicure footwear of FIG. 1, illustrating the positioning of a phantom foot 30 therein.

Referring now to FIGS. 1 and 4, the toe separating portion 18 is preferably sewn, or stitched, to upper surface 14 of base portion 12. However, as will be apparent to those skilled in the art, myriad other means of attaching toe separating portion 18 to surface 14 are available. For example, attachment can be achieved using: mechanical fasteners, such as staples and rivets; chemical adhesives; hook and pile attachments, such as that sold under the trademark VELCRO; and heat seal means, to name just a few. Regardless of the attachment means employed, toe separating portion 18 is strategically secured to surface 14 to form individual toe receiving loops 18(*a–e*) sized for comfortably engaging the individual toes 40–44 of the wearer's foot, and positioned for maintaining adequate separation of said toes.

Preferably, the strength of the resulting attachment regions 20 are adequate to prevent the inadvertent detachment of the toe separating portion at these regions during use. However, it is also preferable that these same attachment regions 20 enable the toe separating portion 18 to be detached by the wearer after the sandal has served its intended function, i.e., after the toe treatment has adequately dried or cured. Accordingly, it is preferred that the strength of the attachment regions 20 is such that the wearer can effectively detach the toe separating portion 18 from surface 14 at these regions by pulling upwards on portion 18. The ability to detach the toe separating portion 18 from surface 14 in this manner results in a significant benefit of the present invention. Namely, the pedicure sandal can be removed and disposed of without requiring the wearer to slide her toes through loops 18(*a–e*), thereby minimizing the potential for damaging the beautification treatment during removal of the sandal.

The novel structure of the present invention provides for significant advantages vis-a-vis known pedicure sandals. Most notably, the integration of the base portion 12 and the toe separation portion 18 into a single-bodied structure has provided for significant material and manufacturing cost reduction. As a result, the pedicure sandals of the present invention can be cost-effectively manufactured for disposable use.

While the preferred embodiments of the invention have been illustrated and described, it will be clear that the invention is not so limited. Numerous modifications, changes, variations, substitutions and equivalents will occur to those skilled in the art without departing from the spirit and scope of the present invention as described in the claims. For example, in lieu of cutting the planar foot forms 26 from sheets of material, planar foot forms 26 can be formed by employing any of a number of known molding technologies.

We claim:

1. A pedicure footwear fabricated from a unitary substrate having upper and lower surfaces and an outer perimeter sized and shaped for accommodating a human foot, comprising:

a base having a rear portion sized and shaped for supporting the heel of a human foot, and a forward portion sized and shaped for supporting the toes of a human foot; and a toe separating portion formed integral to the base and defined by a U-shaped cut line provided slightly inward of said outer perimeter proximate said heel supporting portion;

said toe separating portion forwardly bent above the upper surface of said base and selectively attached thereto to form five radially configured toe-receiving loops.

2. A pedicure footwear as recited in claim 1, wherein said toe separating portion is selectively stitched to said base portion to form said five toereceiving loops.

3. A pedicure footwear as recited in claim 1, wherein said toe separating portion is selectively riveted to said base portion to form said five toereceiving loops.

4. A pedicure footwear as recited in claim 1, wherein said toe separating portion is selectively secured to said base portion using a chemical adhesive to form said five toe-receiving loops.

5. A pedicure footwear as recited in claim 1, wherein said toe separating portion is selectively secured to said base portion using a hook and pile attachment to form said five toe-receiving loops.

6. A pedicure footwear as recited in claim 1, wherein said toe separating portion is selectively secured to said base portion by heat sealing means to form said five toe-receiving loops.

7. A pedicure footwear as recited in claim 1, wherein said unitary substrate is constructed from a single layer of material.

8. A pedicure footwear as recited in claim 7, wherein said single layer of material consists of one of a foam, a rubber, and a flexible plastic.

9. A pedicure footwear as recited in claim 1, wherein said unitary substrate has a multilayer construction.

10. A pedicure footwear as recited in claim 8, wherein said multiple layers include at least two of a foam, a rubber, and a flexible plastic.

11. A method of manufacturing a pedicure footwear from a single flat sheet of relatively soft, resilient material, comprising the steps of:

cutting the sheet to the approximate configuration of the underside of a human foot, but with some longitudinally forward and longitudinally rearward extension thereof;

introducing a U-shaped cut slightly inward of a rear edge portion of said cut sheet to define an integral, partially separated strip portion;

bending said strip portion forward toward a toe supporting region of said cut sheet; and selectively attaching said strip portion to an upper surface of said cut sheet to create five radially configured toe-receiving loops for receiving the wearer's toes and forcing said toes into a spaced apart position.

* * * * *